United States Patent [19]

Tackett et al.

[11] Patent Number: 4,571,170

[45] Date of Patent: Feb. 18, 1986

[54] GLAZING TOOL

[76] Inventors: Edd Tackett, Rte. 3, Box 200-A, Huntsville, Ark. 72740; Mary E. Broscoff, 1817 Miracerros La., Alamogordo, N. Mex. 88310

[21] Appl. No.: 616,664

[22] Filed: Jun. 4, 1984

[51] Int. Cl.[4] ..... B05C 17/10

[52] U.S. Cl. ..... 425/458; 15/235.8

[58] Field of Search ..... 15/235.3, 235.4, 235.5, 15/235.6, 235.7, 235.8, 104 S; 425/87, 458

[56] References Cited

U.S. PATENT DOCUMENTS

| | | | |
|---|---|---|---|
| 2,179,563 | 11/1939 | Sassano | 15/235.8 |
| 2,818,602 | 1/1958 | Haretik et al. | 425/458 |
| 2,902,713 | 9/1959 | Buelow | 425/458 |
| 2,914,798 | 12/1959 | Lausman | 425/458 |

FOREIGN PATENT DOCUMENTS

| | | | |
|---|---|---|---|
| 2371570 | 7/1978 | France | 15/235.7 |

*Primary Examiner*—Edward L. Roberts

*Attorney, Agent, or Firm*—N. J. Aquilino

[57] ABSTRACT

A glazing tool for providing a smooth and uniform bead of putty between a window pane and a window frame formed of a block suitable to be held in the hand of a user. The tool includes a bottom plate which forms a work surface to smooth the putty. A guide bar positioned at the bottom plate is adjustable along the surface of the bottom plate. The guide bar is adapted to engage the edge of a window frame while the other end of the bottom plate slides along the glass to insure the angle of the tool is maintained as a bead of putty is formed.

5 Claims, 4 Drawing Figures

GLAZING TOOL

BACKGROUND OF THE INVENTION

The present invention relates to a glazing tool, and in particular to a glazing tool adapted to provide a smooth bead of putty between a newly inserted window pane and a window frame.

Normally, a tool called a putty knife is used to spread putty in the gap between a window frame and a newly inserted pane of glass to secure the pane in the frame. Putty knives traditionally are flat-bladed instruments with a handle having a straight working edge. When forming a putty bead, the putty knife is normally positioned generally perpendicular to the bead and drawn along the putty material to form a flat and aesthetically pleasing seal. Traditionally, the putty knife has been used for glazing purposes since it is an economical, durable, and lightweight tool which can be used with either hand. However, some disadvantages include the fact that the blade will rust and the finish wears off. The blade also bends under slight pressure and requires a considerable amount of skill to maintain it in a precise position in order to form a uniform putty bead. The professional glazer is normally quite proficient in doing this, however, most homeowners or first-time users of a putty knife find it difficult to properly use. Also, conventional putty knives because of their long handles, can be used only in open spaces. In situations where storm windows or other restrictions are present, a putty knife becomes difficult if not impossible to handle because of the lack of sufficient room to manuever the elongated object. Attempts to overcome the abovementioned difficulties are primarily concentrated on redesigning the known putty knife blade by providing a specific area or edge which is adapted to facilitate applying the putty. Examples are shown in the prior patents to Hall (U.S. Pat. No. 1,000,333), and Strefling (U.S. Pat. No. 2,706,831).

The present invention provides a glazing tool which is non-sticking, inexpensive, easy to use, small, durable, and has the ability to establish the proper angle of application of the putty in the space between the window pane and window frame. It is adjustable, and therefore, can bead the putty and set the angle of application from the most delicate of window sashes to large steel industrial frames of commercial buildings. Once the proper angle is set, the glazing tool will maintain this angle throughout the entire application. Specific skills are not required, and a uniform smooth bead of putty is produced.

The present invention is formed of a block of solid material preferably including suitable indentations in order to conform with the user's hand. The bottom of the block is designed to accept an inexpensive, field replaceable plate having a smooth, non-stick surface and is used to actually smooth the putty. The bottom also mounts a guide bar which may be adjustably moved across the bottom surface so that when the tool is placed with one side against the window pane, the adjustment bar engages the window frame to maintain the exact precise angle at which the smooth exposed bottom surface sets between the frame and the window frame. Means are provided to adjustably secure the guide bar to the bottom surface of the block so that the guide bar is freely adjustable and yet can be tightened against movement when the tool is being used.

Among the objects of the present invention are to provide a glazing tool to lay a uniform bead of putty in the rabbit cut of a window sash; to lay putty in a straight line having the same height from one end to the other of the putty bead, thereby producing putty beads which have a better seal, beads which are more eye appealing, and beads which are comparable to those made by experienced glazers.

Another object of the present invention is to provide a glazing tool which allows less skilled, less experienced individuals to install putty in a rapid, flawless manner.

Still another object of the present invention is to provide a glazing tool which includes an adjustable means of applying putty to various sizes of windows in order to maintain a smooth uniform putty bead.

DESCRIPTION OF THE PREFERRED EMBODIMENTS

Figure 1:
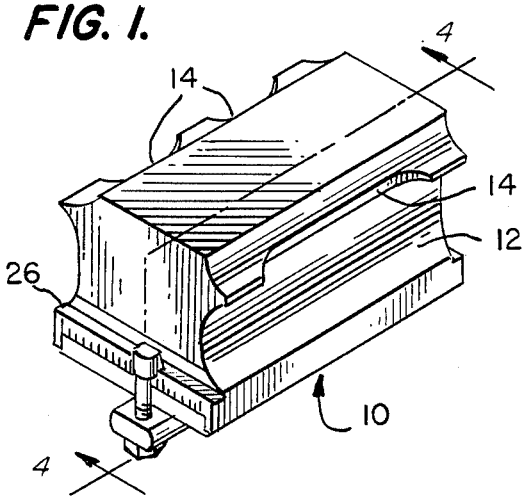
FIG. 1 is a perspective view of the glazing tool of the present invention.
Figure 2:
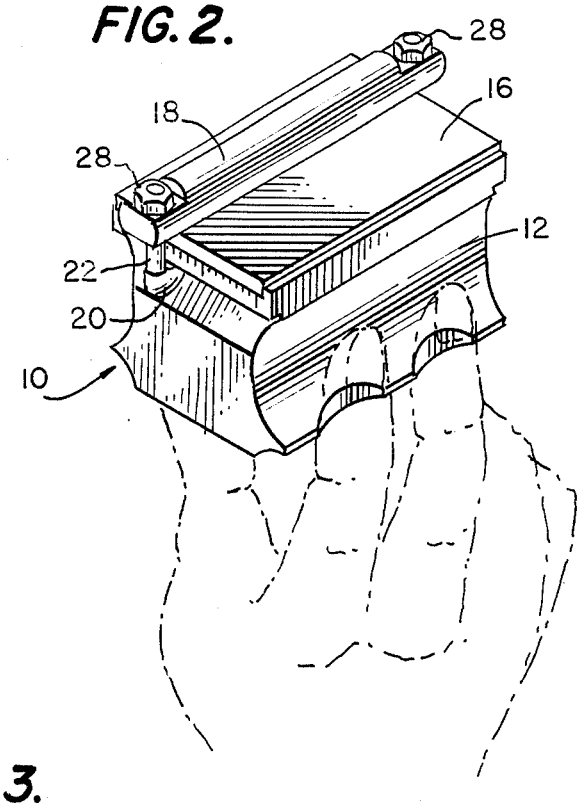
FIG. 2 is a second perspective view of the glazing tool of the present invention showing the bottom working surface.

The drawings show the glazing tool 10 of the present invention. The tool is formed of a generally rectangular block 12 which may be formed from any solid material, such as metal, wood, or plastic or the like. The block 12 includes indentations 14 which are adapted to conform to a user's hand and provide a gripping surface therefor. A working surface is provided by a bottom plate 16 secured on the bottom of the block 12. The plate 16 may be formed out of stainless steel, coated plastic or any other suitable material having a smooth or polished surface. A guide bar 18 cooperates with and is secured against the bottom plate 16.

Figure 4:
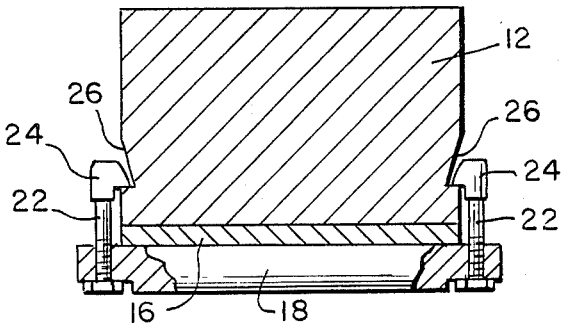
FIG. 4 is a sectional view of the glazing tool taken along the lines 4—4 of FIG. 1.

Suitable screw fasteners 22 are used to secure the guide bar 18 to the bottom plate 16. In the preferred embodiment, the upper portions of the screw fasteners 22 are formed with dovetail connectors 24 and are adapted to slidably ride in dovetail slots 26, as best seen in FIG. 4, formed in the lower ends of the block 12. The bottoms of the screw fasteners 22 fit through corresponding holes in the guide bar 18 and are secured by suitable nuts 28.

It will be appreciated that by loosening each of the nuts 28, the dovetail connectors 24 are permitted to longitudinally slide within the dovetail slots 26 enabling the guide bar 18 to be adjustably moved across the surface of the bottom plate 16 while maintaining its longitudinal axis parallel to the longitudinal axis of the block 12.

Figure 3:
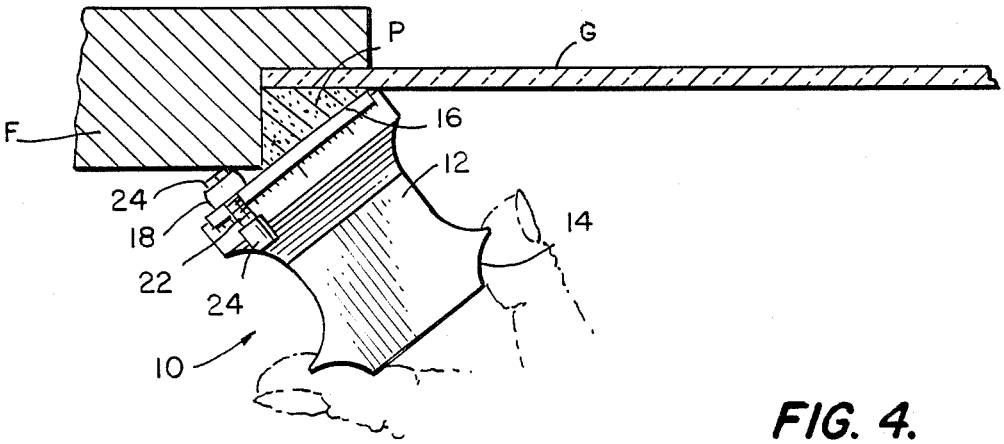
FIG. 3 is a view showing the glazing tool as it is used to draw a bead of putty between a window pane and a window frame.

The manner in which the tool 10 is used can be seen with reference to FIG. 3 which shows a window frame F, a pane of glass G and a measure of putty P used to seal the glass in place in the frame. The tool 10 is positioned so that the side of the bottom plate 16 opposite the guide bar 18 rests against the glass window pane G. The guide bar 18 is then placed over the outer edge of the frame F. This enables the bottom plate 16 to capture the putty P between the frame F and the glass G.

When the proper adjustment of the guide bar 16 has been made, the glazing tool is slid down the entire length of the window. By using a slight inward pressure, the guide bar 18 rides along the edge of the frame F and the side of the bottom plate slides along the glass G. This insures that the tool 10 remains at the same angle relative to the glass G and frame F in order to produce a smooth uniform bead of putty.

By varying the position of the guide bar 18 relative to the sides of the bottom plate 16, as described above, the effective working surface of the bottom plate can be changed as well as the angle at which the glazing tool 10 assumes relative to the frame F and glass G. This permits the depth and angle of the bead of putty P to be varied to accommodate different size windows and window frames.

It is understood that the above description is illustrative of the preferred embodiment of the present invention, however, many variations may be provided in keeping within the scope of the appended claims.

We claim:

1. A glazing tool for providing a smooth and uniform bead of putty between a window pane and window frame comprising: a block shaped body member having an upper portion suitable for engagement by the hand of a user, and a lower surface; said lower surface including a generally rectangular bottom plate; said plate having an integral planer work surface and straight sides, at least one of said straight sides in use engaging a window pane; a guidebar moveably mounted on said bottom plate, said guidebar having an elongated body with at least one straight edge for engaging a window frame; and means for connecting said guidebar to said bottom plate permitting said guidebar to be adjustably moveable across the entire length and width of said planer surface of said rectangular bottom plate; said straight edge of said guidebar and one of said straight sides of said bottom plate being parallel to each other defining a work area therebetween for capturing putty between said window pane and said window frame and smoothing said putty with said planer work surface of said bottom plate.

2. The glazing tool of claim 1 wherein said block shaped body member includes contoured surfaces adapted to conform to the fingers and hand of a user.

3. The glazing tool of claim 1 wherein said means for connecting said guidebar further includes means for securing said guidebar in a locked position against said bottom plate.

4. The glazing tool of claim 3 wherein said guidebar further includes a flat surface for engaging said bottom plate.

5. A glazing tool for providing a smooth and uniform bead of putty between a window pane and a window frame comprising: a block shaped body member having an upper portion suitable for engagement by the hand of a user, and a lower surface; said lower surface including a generally rectangular bottom plate; said bottom plate having an integral planer work surface and straight sides, at least one of said straight sides in use engaging a window pane; a guidebar moveably mounted on said bottom plate; said guidebar having an elongated body with at least one straight edge for engaging a window frame; parallel slots formed in said block shaped body member on opposite sides thereof and extending substantially the entire length of said opposite sides; connector means attached to said guidebar and adapted to be moveably connected within said slots permitting said guidebar to be moved from one side to another side across the surface of said rectangular bottom plate; said straight edge of said guidebar and one of said straight sides of said bottom plate being parallel to each other defining a work area for capturing putty between said window pane and said window frame said planer work surface of said bottom plate smoothing said putty forming a uniform bead.

* * * * *